US008788251B2

(12) United States Patent
Weng et al.

(10) Patent No.: US 8,788,251 B2
(45) Date of Patent: Jul. 22, 2014

(54) METHOD FOR INTERPRETATION OF DISTRIBUTED TEMPERATURE SENSORS DURING WELLBORE TREATMENT

(75) Inventors: Xiaowei Weng, Katy, TX (US); Doug Pipchuk, Calgary (CA); Rex Burgos, Richmond, TX (US); Philippe Tardy, Gannat (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 159 days.

(21) Appl. No.: 12/785,142

(22) Filed: May 21, 2010

(65) Prior Publication Data

US 2011/0288843 A1 Nov. 24, 2011

(51) Int. Cl.
*G06G 7/50* (2006.01)
*G06G 7/48* (2006.01)

(52) U.S. Cl.
USPC ..... 703/10; 703/9

(58) Field of Classification Search
USPC ..... 703/9, 10
See application file for complete search history.

(56) References Cited

U.S. PATENT DOCUMENTS

| | | | | |
|---|---|---|---|---|
| 6,585,044 | B2 | 7/2003 | Rester et al. | |
| 6,595,294 | B1 | 7/2003 | Dalsmo et al. | |
| 7,055,604 | B2 | 6/2006 | Jee et al. | |
| 7,398,680 | B2 * | 7/2008 | Glasbergen et al. | 73/152.12 |
| 7,536,905 | B2 * | 5/2009 | Jalali et al. | 73/152.33 |
| 7,580,797 | B2 * | 8/2009 | Akram et al. | 702/12 |
| 7,658,226 | B2 * | 2/2010 | Ziauddin et al. | 166/250.01 |
| 2002/0023752 | A1 * | 2/2002 | Qu et al. | 166/308 |
| 2004/0129418 | A1 * | 7/2004 | Jee et al. | 166/250.01 |
| 2009/0198478 | A1 | 8/2009 | Cuevas et al. | |
| 2009/0216456 | A1 | 8/2009 | Poe, Jr. | |

OTHER PUBLICATIONS

International Search Report and Written Opinion dated Nov. 24, 2011 for corresponding PCT Application No. PCT/US2011/037561 filed May 23, 2011.

Philippe M.J. Tardy, Bruno Lecerf, Yenny Christant—"An Experimentally Validated Wormhole Model for Self-Diverting and Conventional Acids in Carbonate Rocks Under Radial Flow Conditions," SPE Paper 107854, SPE European Formation Damage Conference, Scheveningen, the Netherlands, May 30-Jun. 1, 2007, pp. 1-16.

* cited by examiner

*Primary Examiner* — Omar Fernandez Rivas
*Assistant Examiner* — Nithya J Moll
(74) *Attorney, Agent, or Firm* — Michael Flynn; Timothy Curington; Robin Nava

(57) ABSTRACT

A method for determining flow distribution in a formation having a wellbore formed therein includes the steps of positioning a sensor within the wellbore, wherein the sensor generates a feedback signal representing at least one of a temperature and a pressure measured by the sensor, injecting a fluid into the wellbore and into at least a portion of the formation adjacent the sensor, shutting-in the wellbore for a pre-determined shut-in period, generating a simulated model representing at least one of simulated temperature characteristics and simulated pressure characteristics of the formation during the shut-in period, generating a data model representing at least one of actual temperature characteristics and actual pressure characteristics of the formation during the shut-in period, wherein the data model is derived from the feedback signal, comparing the data model to the simulated model, and adjusting parameters of the simulated model to substantially match the data model.

19 Claims, 6 Drawing Sheets

METHOD FOR INTERPRETATION OF DISTRIBUTED TEMPERATURE SENSORS DURING WELLBORE TREATMENT

BACKGROUND OF THE INVENTION

The statements in this section merely provide background information related to the present disclosure and may not constitute prior art.

The present disclosure relates generally to wellbore treatment and development of a reservoir and, in particular, to a method for determining flow distribution in a wellbore during a treatment.

Hydraulic fracturing, matrix acidizing, and other types of stimulation treatments are routinely conducted in oil and gas wells to enhance hydrocarbon production. The wells being stimulated often include a large section of perforated casing or an open borehole having significant variation in rock petrophysical and mechanical properties. As a result, a treatment fluid pumped into the well may not flow to all desired hydrocarbon bearing layers that need stimulation. To achieve effective stimulation, the treatments often involve the use of diverting agents in the treating fluid, such as chemical or particulate material, to help reduce the flow into the more permeable layers that no longer need stimulation and increase the flow into the lower permeability layers.

One method includes conducting the treatment through a coiled tubing, which can be positioned in the wellbore to direct the fluid immediately adjacent to layers that need to be plugged when pumping a diverter and adjacent to layers that need stimulation when pumping stimulation fluid. However, the coiled tubing technique requires an operator to know which layers need to be treated by a diverter and which layers need to be treated by a stimulation fluid. In a well with long perforated or open intervals with highly non-uniform and unknown rock properties, typical of horizontal wells, effective treatment requires knowledge of the flow distribution in the treated interval.

Traditional flow measurement in a well is typically done through production logging using a flow meter to measure the hydrocarbon production rate or injection rate in the wellbore as a function of depth. Based on the logged wellbore flow rate, the production from or injection rate into each formation depth interval is determined based on a measured axial flow rate over that interval. Traditional flow measurement is valid as long as the flow distribution in the well does not change over the time period when logging is conducted.

However, during a stimulation treatment, the flow distribution in a well can change quickly due to either stimulation of the formation layers to increase their flow capacity or temporary reduction in flow capacity as a result of diverting agents. To determine the effectiveness of stimulation or diversion in the well, an instantaneous measurement that gives a "snap shot" of the flow distribution in a well is desired. Unfortunately, there are few such techniques available.

One technique for substantially instantaneous measurement is fiber optic Distributed Temperature Sensing (DTS) technology. DTS typical includes an optical fiber disposed in the wellbore (e.g. via a permanent fiber optic line cemented in the casing, a fiber optic line deployed using a coiled tubing, or a slickline unit). The optical fiber measures a temperature distribution along a length thereof based on an optical time-domain (e.g. optical time-domain reflectometry (OTDR), which is used extensively in the telecommunication industry).

One advantage of DTS technology is the ability to acquire in a short time interval the temperature distribution along the well without having to move the sensor as in traditional well logging which can be time consuming. DTS technology effectively provides a "snap shot" of the temperature profile in the well. DTS technology has been utilized to measure temperature changes in a wellbore after a stimulation injection, from which a flow distribution of an injected fluid can be qualitatively estimated. The inference of flow distribution is typically based on magnitude of temperature "warm-back" during a shut-in period after injecting a fluid into the wellbore and surrounding portions of the formation. The injected fluid is typically colder than the formation temperature and a formation layer that receives a greater fluid flow rate during the injection has a longer "warm back" time compared to a layer or zone of the formation that receives relatively less flow of the fluid.

As a non-limiting example, FIG. 1 illustrates a graphical plot 2 of a plurality of simulated temperature profiles 4 of a laminated formation 6 during a six hour time period of "warm back", according to the prior art. As shown, the X-axis 8 of the graphical plot 2 represents temperature in Kelvin (K) and the Y-axis 9 of the graphical plot 2 represents a depth in meters (m) measured from a pre-determined surface level. As shown, a permeability of each layer of the laminated formation 6 is estimated in units of millidarcies (mD). The layers of the formation 6 having a relatively high permeability receive more fluid during injection and a time period for "warm back" is relatively long (i.e. after a given time period, a change in temperature is less than a change in temperature of the layers having a lower permeability). The layers of the formation 6 having a relatively low permeability receive less fluid during injection and a time period for "warm back" is relatively short (i.e. after a given time period, a change in temperature is greater than a change in temperature of the layers having a higher permeability).

By obtaining and analyzing multiple DTS temperature traces during the shut-in period, the injection rate distribution among different formation layers can be determined. However, current DTS interpretation techniques and methods are based on visualization of the temperature change in the DTS data log, and is qualitative in nature, at best. The current interpretation methods are further complicated in applications where a reactive fluid, such as acid, is pumped into the wellbore, wherein the reactive fluid reacts with the formation rock and can affect a temperature of the formation, leading to erroneous interpretation. In order to achieve effective stimulation, more accurate DTS interpretation methods are needed to help engineers determine the flow distribution in the well and make adjustments in the treatment accordingly.

This disclosure proposes several methods for quantitatively determining the flow distribution from DTS measurement. These methods are discussed in detail below.

SUMMARY OF THE INVENTION

An embodiment of a method for determining flow distribution in a formation having a wellbore formed therein comprises the steps of: positioning a sensor within the wellbore, wherein the sensor generates a feedback signal representing at least one of a temperature and a pressure measured by the sensor; injecting a fluid into the wellbore and into at least a portion of the formation adjacent the sensor; shutting-in the wellbore for a pre-determined shut-in period; generating a simulated model representing at least one of simulated temperature characteristics and simulated pressure characteristics of the formation during the shut-in period; generating a data model representing at least one of actual temperature characteristics and actual pressure characteristics of the formation during the shut-in period, wherein the data model is derived from the feedback signal; comparing the data model to the simulated model; and adjusting parameters of the simulated model to substantially match the data model.

In an embodiment, a method for determining flow distribution in a formation having a wellbore formed therein comprises the steps of: positioning a sensor within the wellbore, wherein the sensor provides a substantially continuous temperature monitoring along a pre-determined interval, and wherein the sensor generates a feedback signal representing temperature measured by the sensor; injecting a fluid into the wellbore and into at least a portion of the formation adjacent the interval; shutting-in the wellbore for a pre-determined shut-in period; generating a simulated model representing simulated thermal characteristics of at least a sub-section of the interval during the shut-in period; generating a data model representing actual thermal characteristics of the at least a sub-section of the interval, wherein the data model is derived from the feedback signal; comparing the data model to the simulated model; and adjusting parameters of the simulated model to substantially match the data model.

In an embodiment, a method for determining flow distribution in a formation having a wellbore formed therein comprises the steps of: a) positioning a distributed temperature sensor on a fiber extending along an interval within the wellbore, wherein the distributed temperature sensor provides substantially continuous temperature monitoring along the interval, and wherein the sensor generates a feedback signal representing temperature measured by the sensor; b) injecting a fluid into the wellbore and into at least a portion of the formation adjacent the interval; c) shutting-in the wellbore for a pre-determined shut-in period; d) generating a simulated model representing simulated thermal characteristics of a sub-section of the interval during the shut-in period; e) generating a data model representing actual thermal characteristics of the sub-section of the interval, wherein the data model is derived from the feedback signal; f) comparing the data model to the simulated model; g) adjusting parameters of the simulated model to substantially match the data model; and h) repeating steps d) through g) for each of a plurality of sub-sections defining the interval within the wellbore to generate a flow profile representative of the entire interval.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 2:
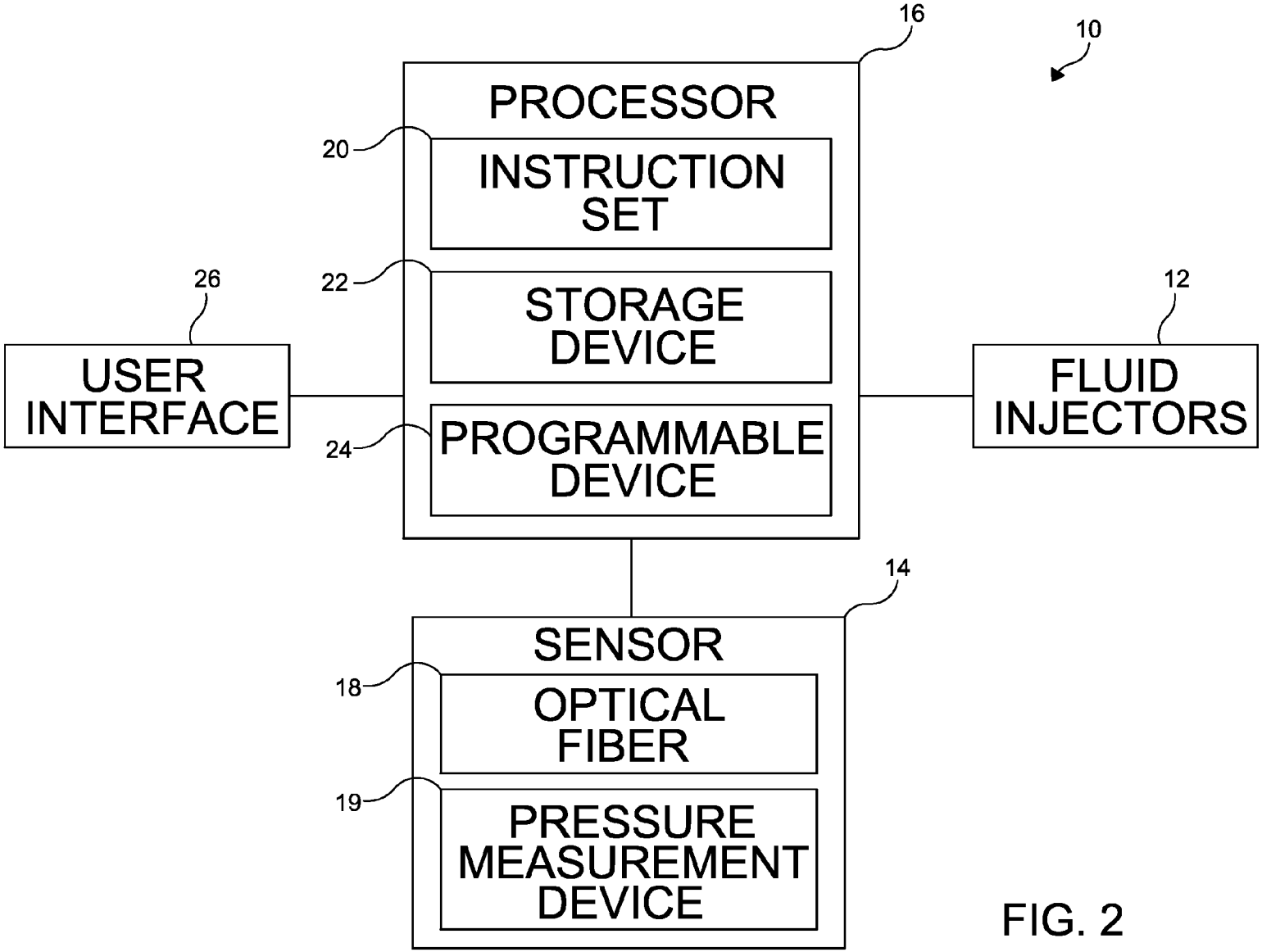
FIG. 2 is a schematic diagram of an embodiment of a wellbore treatment system.

Referring now to FIG. 2, there is shown an embodiment of a wellbore treatment system according to the invention, indicated generally at 10. As shown, the system 10 includes a fluid injector(s) 12, a sensor 14, and a processor 16. It is understood that the system 10 may include additional components.

The fluid injector 12 is typically a coiled tubing, which can be positioned in a wellbore formed in a formation to selectively direct a fluid to a particular depth or layer of the formation. For example, the fluid injector 12 can direct a diverter immediately adjacent a layer of the formation to plug the layer and minimize a permeability of the layer. As a further example, the fluid injector 12 can direct a stimulation fluid adjacent a layer for stimulation. It is understood that other means for directing fluids to various depths and layers can be used, as appreciated by one skilled in the art of wellbore treatment. It is further understood that various treating fluids, diverters, and stimulation fluids can be used to treat various layers of a particular formation.

The sensor 14 is typically of Distributed Temperature Sensing (DTS) technology including an optical fiber 18 disposed in the wellbore (e.g. via a permanent fiber optic line cemented in the casing, a fiber optic line deployed using a coiled tubing, or a slickline unit). The optical fiber 18 measures the temperature distribution along a length thereof based on optical time-domain (e.g. optical time-domain reflectometry). In certain embodiments, the sensor 14 includes a pressure measurement device 19 for measuring a pressure distribution in the wellbore and surrounding formation. In certain embodiments, the sensor 14 is similar to the DTS technology disclosed in U.S. Pat. No. 7,055,604 B2, hereby incorporated herein by reference in its entirety.

The processor 16 is in data communication with the sensor 14 to receive data signals (e.g. a feedback signal) therefrom and analyze the signals based upon a pre-determined algorithm, mathematical process, or equation, for example. As shown in FIG. 2, the processor 16 analyzes and evaluates a received data based upon an instruction set 20. The instruction set 20, which may be embodied within any computer readable medium, includes processor executable instructions for configuring the processor 16 to perform a variety of tasks and calculations. As a non-limiting example, the instruction set 20 may include a comprehensive suite of equations governing a physical phenomena of fluid flow in the formation, a fluid flow in the wellbore, a fluid/formation (e.g. rock) interaction in the case of a reactive stimulation fluid, a fluid flow in a fracture and its deformation in the case of hydraulic fracturing, and a heat transfer in the wellbore and in the formation. As a further non-limiting example, the instruction set 20 includes a comprehensive numerical model for carbonate acidizing such as described in Society of Petroleum Engineers (SPE) Paper 107854, titled "An Experimentally Validated Wormhole Model for Self-Diverting and Conventional Acids in Carbonate Rocks Under Radial Flow Conditions," and authored by P. Tardy, B. Lecerf and Y. Christanti, hereby incorporated herein by reference in its entirety. It is understood that any equations can be used to model a fluid flow and a heat transfer in the wellbore and adjacent formation, as appreciated by one skilled in the art of wellbore treatment. It is further understood that the processor 16 may execute a variety of functions such as controlling various settings of the sensor 14 and the fluid injector 12, for example.

As a non-limiting example, the processor 16 includes a storage device 22. The storage device 22 may be a single storage device or may be multiple storage devices. Furthermore, the storage device 22 may be a solid state storage system, a magnetic storage system, an optical storage system or any other suitable storage system or device. It is understood that the storage device 22 is adapted to store the instruction set 20. In certain embodiments, data retrieved from the sensor 14 is stored in the storage device 22 such as a temperature measurement and a pressure measurement, and a history of previous measurements and calculations, for example. Other data and information may be stored in the storage device 22 such as the parameters calculated by the processor 16 and a database of petrophysical and mechanical properties of various formations, for example. It is further understood that certain known parameters and numerical models for various formations and fluids may be stored in the storage device 22 to be retrieved by the processor 16.

As a further non-limiting example, the processor 16 includes a programmable device or component 24. It is understood that the programmable device or component 24 may be in communication with any other component of the system 10 such as the fluid injector 12 and the sensor 14, for example. In certain embodiments, the programmable component 24 is adapted to manage and control processing functions of the processor 16. Specifically, the programmable component 24 is adapted to control the analysis of the data signals (e.g. feedback signal generated by the sensor 14) received by the processor 16. It is understood that the programmable component 24 may be adapted to store data and information in the storage device 22, and retrieve data and information from the storage device 22.

In certain embodiments, a user interface 26 is in communication, either directly or indirectly, with at least one of the fluid injector 12, the sensor 14, and the processor 16 to allow a user to selectively interact therewith. As a non-limiting example, the user interface 26 is a human-machine interface allowing a user to selectively and manually modify parameters of a computational model generated by the processor 16.

In use, a fluid is injected into a formation (e.g. laminated rock formation) to remove or by-pass a near well damage, which may be caused by drilling mud invasion or other mechanisms, or to create a hydraulic fracture that extends hundreds of feet into the formation to enhance well flow capacity. A temperature of the injected fluid is typically lower than a temperature of each of the layers of the formation. Throughout the injection period, the colder fluid removes thermal energy from the wellbore and surrounding areas of the formation. Typically, the higher the inflow rate into the formation, the greater the injected fluid volume (i.e. its penetration depth into the formation), and the greater the cooled region. In the case of hydraulic fracturing, the injected fluid enters the created hydraulic fracture and cools the region adjacent to the fracture surface. When pumping stops, the heat conduction from the reservoir gradually warms the fluid in the wellbore. Where a portion of the formation does not receive inflow during injection will warm back faster due to a smaller cooled region, while the formation that received greater inflow warms back more slowly.

Figure 3:
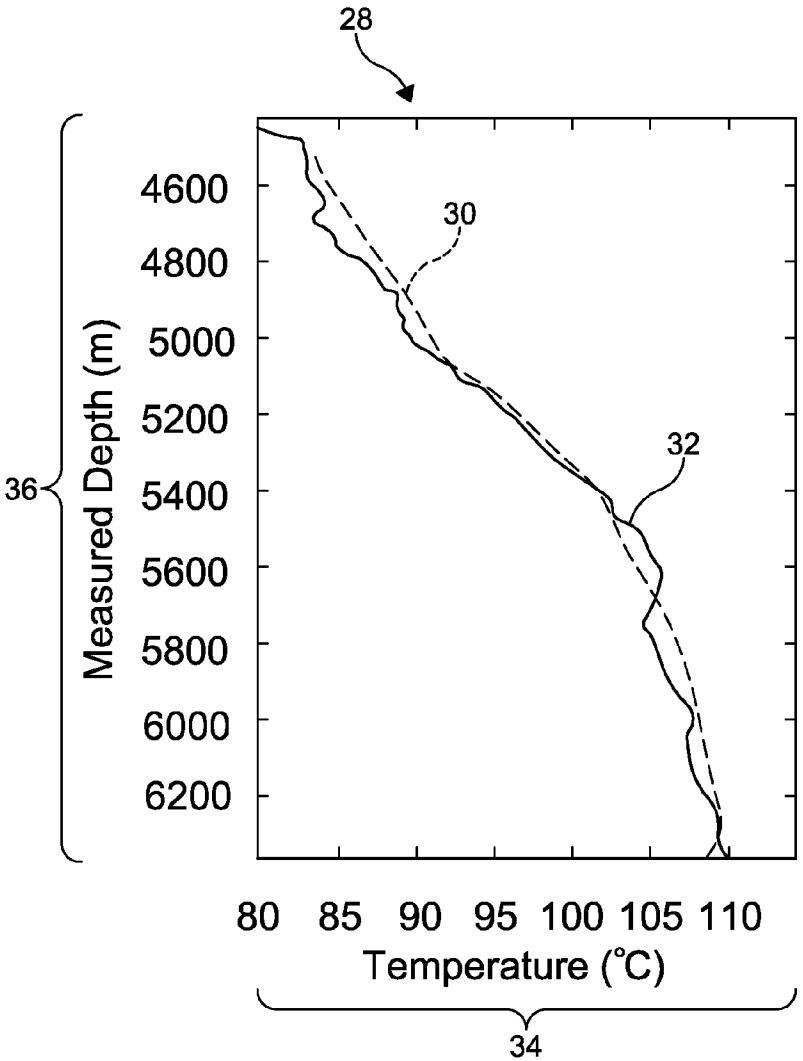
FIG. 3 is a graphical plot showing an embodiment of a simulated temperature profile and an actual measured temperature profile for a wellbore treatment at a first time period.

FIG. 3 illustrates a graphical plot 28 showing a simulated temperature profile 30 and an actual measured temperature profile 32 for a wellbore treatment (e.g. an acid treatment in a horizontal well in a carbonate formation) at a first time period. As a non-limiting example, the first time period is immediately after the shut-in procedure (i.e, stopping the wellbore treatment and ceasing fluid flow into the formation or the like) has been initiated. As shown, the X-axis 34 of the graphical plot 28 represents temperature in degrees Celsius (° C.) and the Y-axis 36 of the graphical plot 28 represents a depth of the formation in meters (m), measured from a pre-determined surface level. In certain embodiments, the simulated temperature profile 30 is based on at least one of estimated petrophysical, mechanical, and thermal properties of the formation, thermal properties (e.g. thermal conductivity and heat capacity) of the inject fluid, and flow properties of the inject fluid and formation. As a non-limiting example, the estimated properties of the formation can be manually provided by a user. As a further non-limiting example, the estimated properties can be generated by the processor 16 based upon stored data and known or estimated information about the formation. It is understood that a simulated pressure profile (not shown) can be generated by the processor 16 based on the estimated properties of the formation. The actual measured temperature profile 32 is based upon a data acquired by the sensor 14 during the shut-in after a period of fluid injection.

Figure 4:
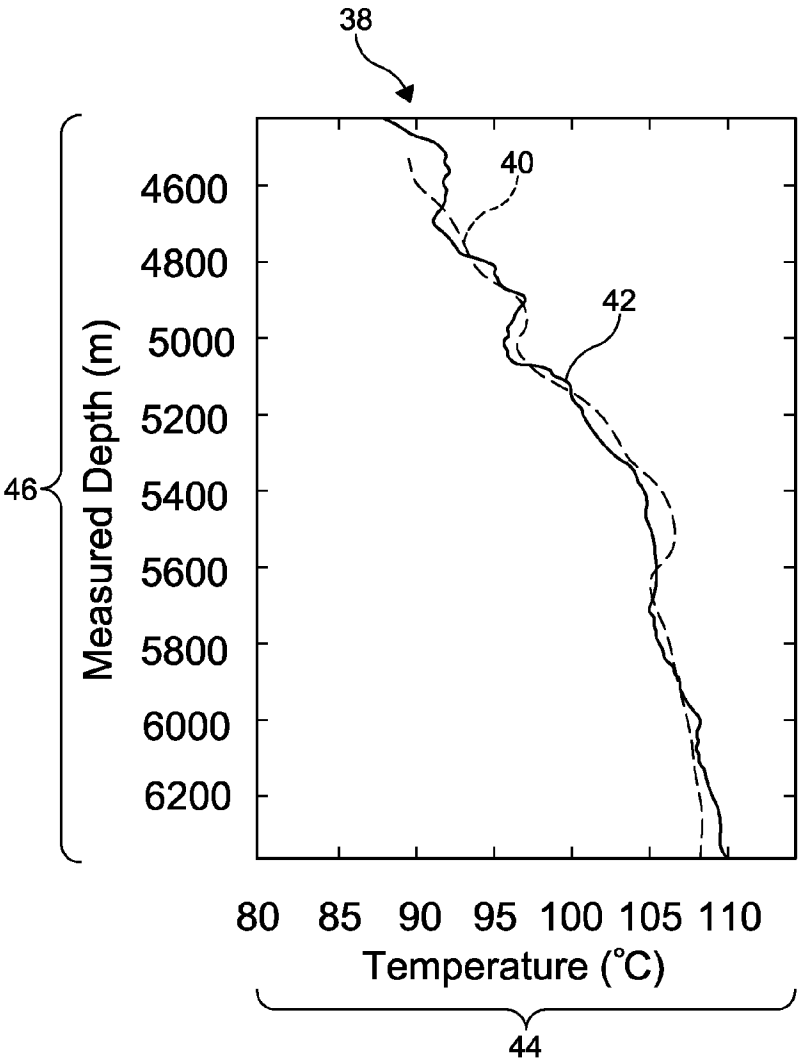
FIG. 4 is a graphical plot showing a simulated temperature profile and an actual measured temperature profile for the wellbore treatment shown in FIG. 3, taken at a second time period.

FIG. 4 illustrates a graphical plot 38 showing a simulated temperature profile 40 and an actual measured temperature profile 42 for a wellbore treatment (e.g. an acid treatment in a horizontal well in a carbonate formation) at a second time period. As a non-limiting example, the second time period is approximately four hours after the first time period. It is understood that any time period can be used. As shown, the X-axis 44 of the graphical plot 38 represents temperature in degrees Celsius (° C.) and the Y-axis 46 of the graphical plot 38 represents a depth of the formation in meters (m), measured from a pre-determined surface level. In certain embodiments, the simulated temperature profile 40 is based on at least one of estimated petrophysical, mechanical, and thermal properties of the formation, thermal properties (e.g. thermal conductivity and heat capacity) of the inject fluid, and flow properties of the inject fluid and formation. As a non-limiting example, the estimated properties of the formation can be manually provided by a user. As a further non-limiting example, the estimated properties can be generated by the processor 16 based upon stored data and known information about a location of the formation. It is understood that a simulated pressure profile (not shown) can be generated by the processor 16 based on the estimated properties of the formation. The actual measured temperature 32 is based upon a data acquired by the sensor 14 during the shut-in after a period of fluid injection.

As an illustrative example a layer of the formation at a particular depth is estimated to have a first set of petrophysical properties having a particular permeability and the simulated temperature profiles 30, 40 are generated based upon a model of the estimated properties of the formation (i.e. forward model simulation). However, where the actual measured temperatures 32, 42 are not aligned with the simulated temperature profiles 30, 40 the user modifies at least one of the estimated properties of the formation and the parameters of the model relied upon to generate the simulated temperature profiles 30, 40 such that the simulated temperature profiles 30, 40 substantially match the actual measured temperatures 32, 42. In this way, the model used to generate the simulated temperature profiles 30, 40 is updated based upon the actual measurements of the sensor 14. It is understood that the updated model can be used as a base model for future applications on the same or similar formation. It is further understood that the flow distribution in the formation can be quantitatively determined from the updated model.

Figures 5, 6, 7:
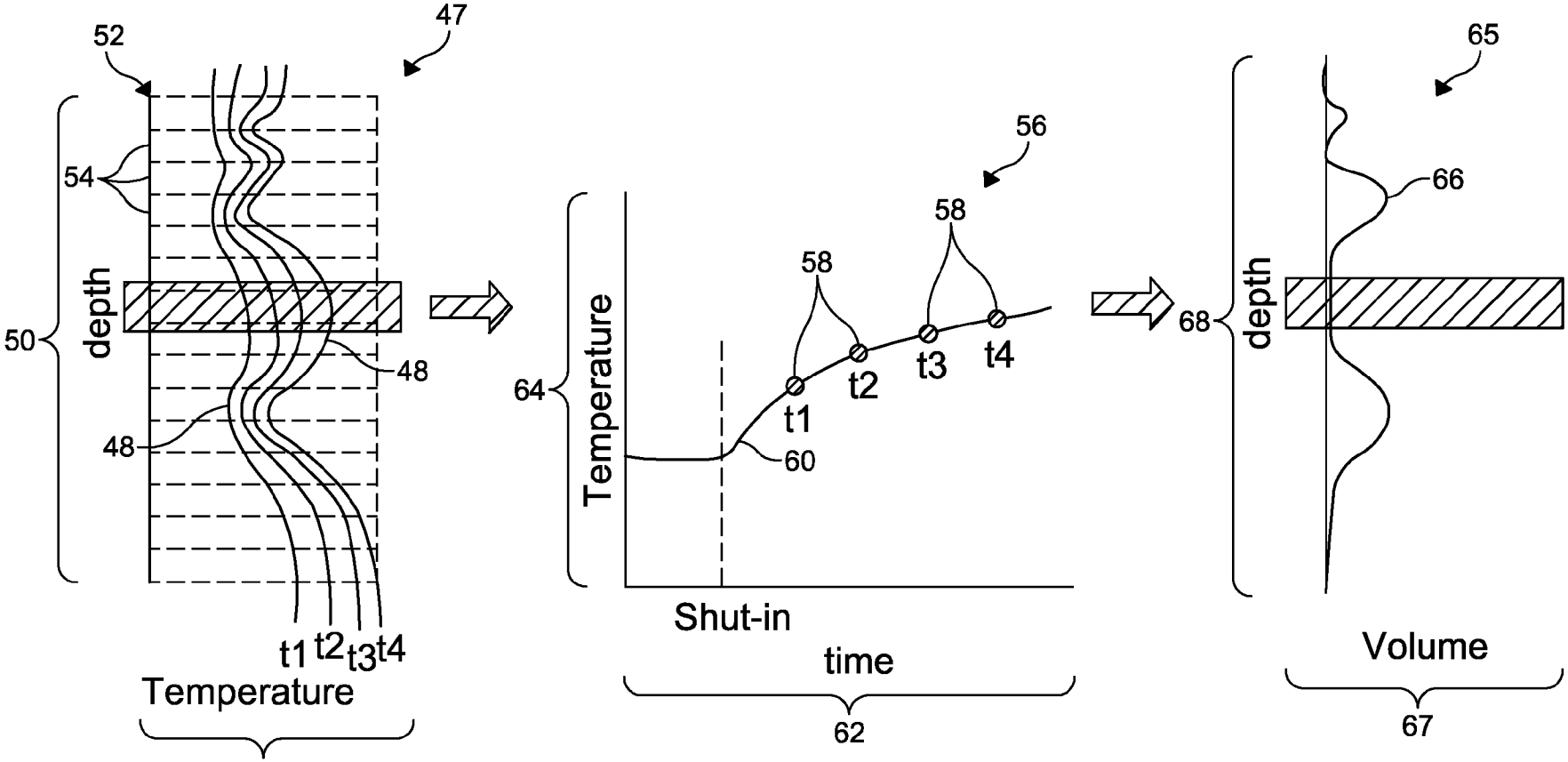
FIG. 5 is a schematic plot showing an embodiment of a plurality of measured temperature profiles, each of the measured temperature profiles taken at a discrete time period during a shut-in period of a wellbore treatment.
FIG. 6 is a graphical representation of temperature vs. time for a sub interval of the profile represented in FIG. 5.
FIG. 7 is a graphical representation of an interpreted flow profile of the wellbore treatment represented in FIG. 5.

FIGS. 5-7 illustrate a method for determining a flow distribution in a formation according to another embodiment of the present invention. As a non-limiting example, the flow distribution in the formation is determined using a numerical inversion algorithm. As a further non-limiting example, a simulated temperature curve (i.e. simulated model) is generated for a given flow rate, an injection fluid temperature, and an initial formation temperature for any given depth by solving a numerical finite difference heat transfer model for modeling a convective flow of a cooler fluid into a permeable formation, as appreciated by one skilled in the art.

FIG. 5 illustrates a schematic plot 47 showing a plurality of measured temperature profiles 48, each of the measured temperature profiles 48 taken at a discrete time period t1, t2, t3, t4 during the shut-in period after an injection. As shown, the X-axis 49 of the graphical plot 47 represents temperature and the Y-axis 50 of the graphical plot 47 represents a depth of the formation measured from a pre-determined surface level. In certain embodiments, a wellbore interval of interest 52 is divided into a plurality of sub sections 54 of pre-determined cross-sectional length. For each of the sub sections 54 the measured temperature profile is plotted against time, as shown in FIG. 6.

Specifically FIG. 6 illustrates a graphical plot 56 showing a plurality of discrete temperature measurements 58 of the sensor 14, each of the measurements taken at the discrete time periods t1, t2, t3, t4, respectively. A theoretical temperature curve 60 (i.e. simulated model) is modeled to intersect the discrete measurements 58. As shown, the X-axis 62 of the graphical plot 56 represents time and the Y-axis 64 of the graphical plot 56 represents a temperature.

In particular, the temperature measurements 58 for a particular one of the sub sections 54 are compared to the theoretical temperature curve 60. In certain embodiments a numerical optimization algorithm is applied to the measured temperature measurements 58 and the theoretical temperature curve 60 to find a "best match" and to minimize an error difference therebetween. For example, the numerical optimization algorithm is a sum of squares of the difference between the data values of temperature measurements 58 and corresponding points along the theoretical temperature curve 60. As a further example, a plurality of input parameters for generating the theoretical temperature curve 60 (i.e. simulated model) are automatically modified to obtain a best match between the theoretical temperature curve 60 and the temperature measurements 58. In certain embodiments, the input parameters include a flow rate during injection, a fluid temperature, an initial formation temperature, and a flow rate during shut-in, for example. It is understood that a number of discrete combinations of the input parameters may generate the same theoretical temperature curve. As such, an average of the input parameters can be used for the fitting procedure between the theoretical temperature curve 60 and the temperature measurements 58.

Once the theoretical temperature curve 60 is "fitted" to the temperature measurements 58, the modified input parameters of the theoretical temperature curve 60 represent the average flow rate, the fluid temperature, and the initial formation temperature. A flow profile (i.e. the profile of the fluid volume injected during the injection period) can be obtained by repeating the comparison and fitting process described above for the remainder of the sub sections 54. As an example, FIG. 7 illustrates a graphical plot 65 showing a flow profile 66 (i.e. a flow distribution). As shown, the X-axis 67 of the graphical plot 65 represents a volume of injected fluid and the Y-axis 68 of the graphical plot 65 represents a depth of the formation measured from a pre-determined surface level.

Figure 1:
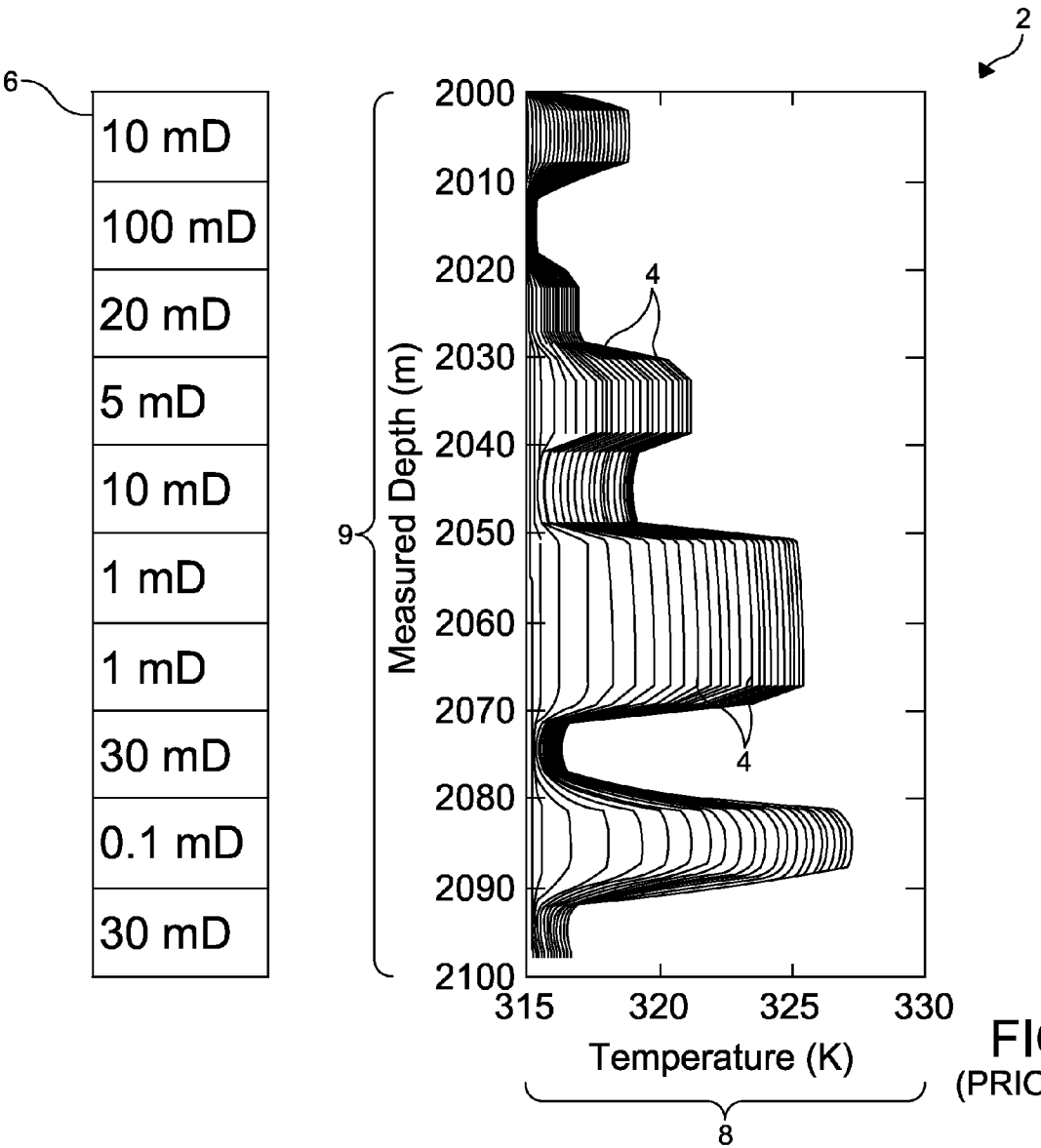
FIG. 1 (PRIOR ART)
FIG. 1 is a graphical plot of a plurality of simulated temperature profiles of a laminated formation during a six hour time period of warm back, according to the prior art.
Figure 8B:
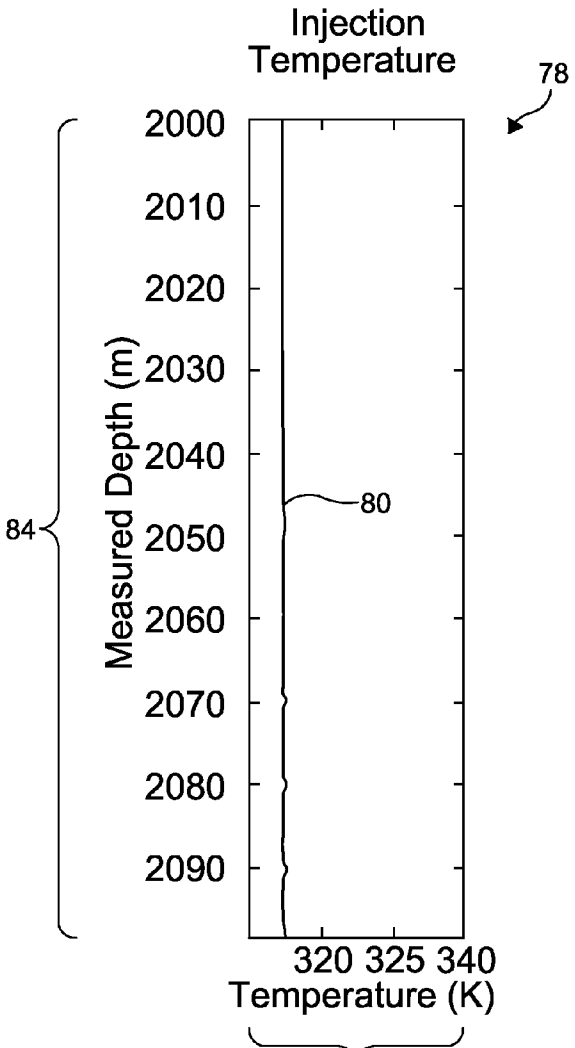
FIG. 8B is graphical plot of an interpreted temperature of a fluid prior to injection into the laminated formation of FIG. 1.
Figure 8A:
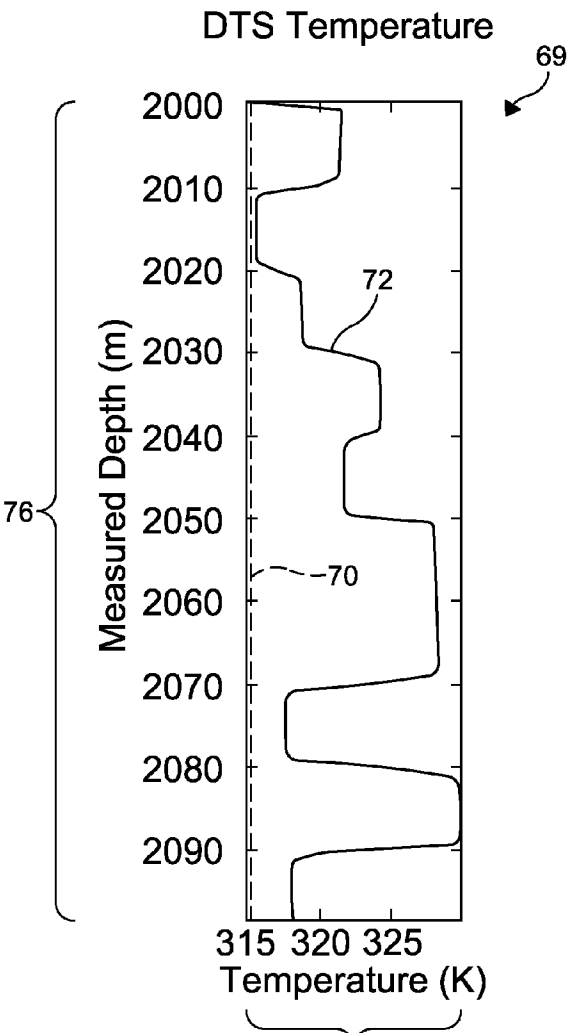
FIG. 8A is a graphical plot of a measured temperature profile of the laminated formation of FIG. 1.

FIGS. 8A-8D illustrate an example of applying a numerical inversion algorithm to the synthetic data generated by a numerical simulator, as shown in FIG. 1. In particular, FIG. 8A illustrates a graphical plot 69 showing a first measured temperature profile 70 taken at a first time period and a second measured temperature profile 72 taken at a second time period. As a non-limiting example the first time period is immediately after a shut-in procedure is initiated and the second time period is six hours after the first time period. It is understood that any time period can be used. As shown, the X-axis 74 of the graphical plot 69 represents temperature in Kelvin (K) and the Y-axis 76 of the graphical plot 69 represents a depth of the formation in meters (m), measured from a pre-determined surface level.

Figure 8D:
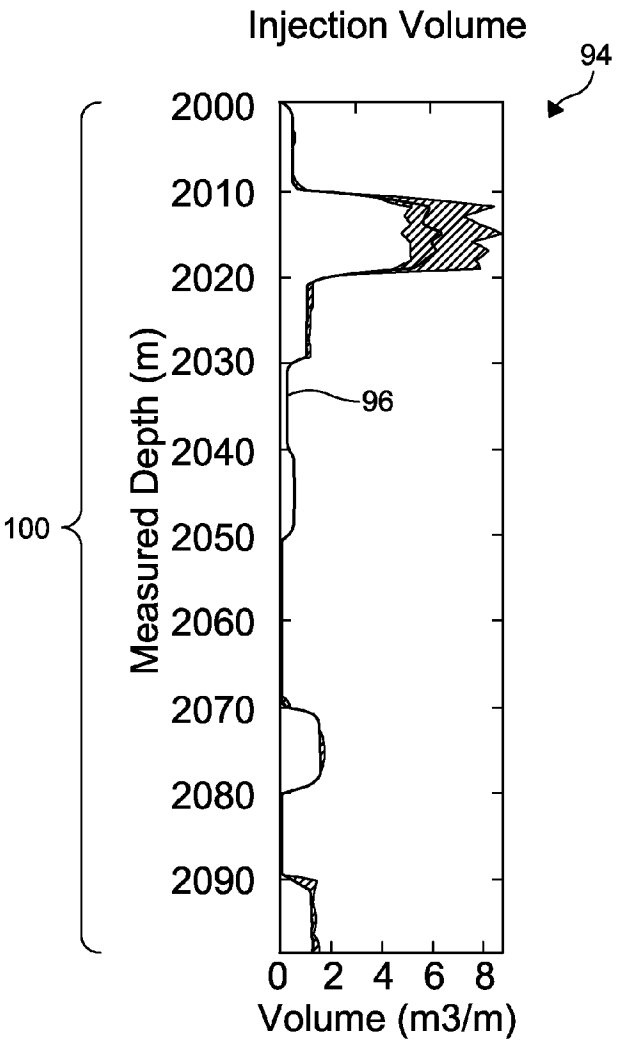
FIG. 8D is graphical plot of an interpreted volume of fluid injected into the laminated formation of FIG. 1 at various depths thereof.
Figure 8C:
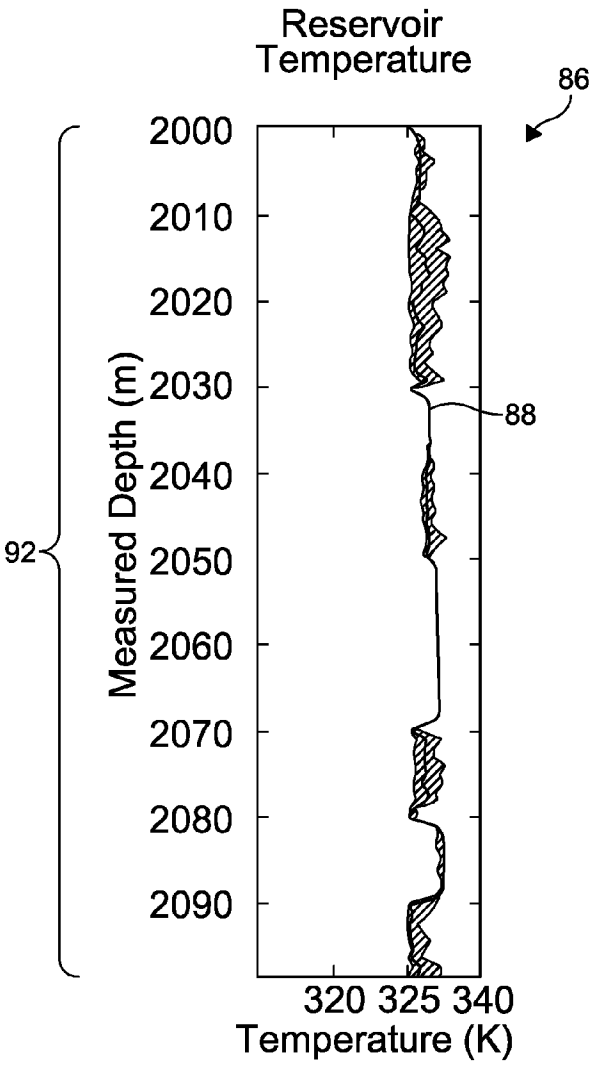
FIG. 8C is graphical plot of an interpreted temperature of the laminated formation of FIG. 1, prior to an injection procedure.

In operation, a theoretical temperature curve (i.e. simulated model) is generated based upon a numerical finite difference heat transfer model for modeling a convective flow of a cooler fluid into a permeable formation, as appreciated by one skilled in the art. As a non-limiting example, the input parameters of the heat transfer model include estimates for a flow rate during injection, a fluid temperature, an initial formation temperature, and a flow rate during shut-in. The temperature profiles 70, 72 are compared to the theoretical curve in a manner similar to that shown in FIG. 6. In certain embodiments a numerical optimization algorithm is applied to the measured temperature profiles 70, 72 and the theoretical curve to automatically find a "best match" and to minimize an error difference between the temperature profiles 70, 72 and the theoretical curve. As a non-limiting example, the input parameters are modified so that the resultant theoretical temperature curve substantially matches an appropriate one of the temperature profiles 70, 72. Once the theoretical curve is "fitted" to the appropriate one of the temperature profiles 70, 72, the modified input parameters of the theoretical curve represent the average flow rate, the fluid temperature, and the initial formation temperature, as shown in FIGS. 8B, 8C, and 8D respectively. It is understood that a number of discrete combinations of the input parameters may generate the same theoretical temperature curve. As such, an average of the input parameters can be used for the fitting procedure between the theoretical temperature curve and the temperature the temperature profiles 70, 72.

Specifically, FIG. 8B is a graphical plot 78 showing an inversed (i.e. interpreted from the inversion algorithm) temperature curve 80 for the injected fluid. As shown, the X-axis 82 of the graphical plot 78 represents temperature in Kelvin (K) and the Y-axis 84 of the graphical plot 78 represents a depth of the formation in meters (m), measured from a pre-determined surface level. FIG. 8C is a graphical plot 86 showing an average temperature profile 88 for the formation prior to receiving the injected fluid (with a standard deviation shown as a shaded region). As shown, the X-axis 90 of the graphical plot 86 represents temperature in Kelvin (K) and the Y-axis 92 of the graphical plot 86 represents a depth of the formation in meters (m), measured from a pre-determined surface level. FIG. 8D is a graphical plot 94 showing a simulated average volume curve 96 for the injected fluid (with a standard deviation shown as a shaded region). As shown, the X-axis 98 of the graphical plot 94 represents volume in cubic meters of fluid injected into one meter of the formation ($m^3$/m) and the Y-axis 100 of the graphical plot 94 represents a depth of the formation in meters (m), measured from a predetermined surface level. As such, the temperature curve 80, temperature profile 88, and the volume curve 96 provide an accurate flow distribution profile for the formation, which can be relied upon for subsequent treatment processes.

In an embodiment, a temperature data measured by the sensor 14 is compared against a set of pre-generated theoretical curves called type curves. The type curves are typically in dimensionless form, with dimensionless variables expressed as a combination of physical variables. The temperature data received from the sensor 14 is pre-processed to be presented in dimensionless form and to overlay on the theoretical type curves. By shifting the measured temperature data to find a best matched type curve, one can determine the physical parameters that correspond to the matched type curve, including the flow rate into the formation. Carrying out the same procedure for all depths, one can construct a flow profile along the wellbore as in the previous methods. An example of type curve techniques for DTS interpretation is disclosed in U.S. Pat. Appl. Pub. No. 2009/0216456, hereby incorporated herein by reference in its entirety.

Several DTS interpretation methods have been discussed herein. The methods involve using a mathematical model (simulated model) to predict the expected temperature response and compare the prediction with actual measurements (measured data model). By adjusting the simulated model parameters to match the measured data model, a flow distribution in the well is deduced. For those skilled in the art, different temperature models can be used, or different techniques could be used to attain the match with the DTS measured data. However, such variations fall under the spirit of this invention.

The interpreted flow profile provides stimulation field practitioners with detailed knowledge to make real time decisions to tailor the stimulation operation to maximize the stimulation effectiveness. The stimulation operations may include the following activities: position coiled tubing to a zone that has not been effectively stimulated to maximize stimulation fluid contact/inflow into that zone; position coiled tubing to a zone that has already been fully stimulated to spot a diverting agent to temporarily plug the zone so the subsequent stimulation fluid can flow into other zones that need further stimulation, rather than wasting fluid in the already stimulated zone; switch a treating fluid if it is shown ineffective; switch a diverter if it is shown ineffective; and set a temporary plug or other types of mechanical barrier in the well to isolate the already stimulated zones to allow separate treatment of the remaining zones. Other operations may rely on the flow profile generated by embodiments of the methods disclosed herein.

To maximize stimulation effectiveness, a stimulation operation can be designed to consist of multiple injection cycles followed by shut-in periods in which DTS data is acquired. The DTS data is analyzed immediately to provide the field operator with the flow distribution in the well, which can be used to make adjustments of the subsequent treatment schedule if necessary to maximize stimulation effectiveness. Well production can hence be maximized as a result of the optimized stimulation.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

We claim:

1. A method for determining a flow profile in a formation having a wellbore formed therein, comprising:

positioning a sensor within the wellbore;

generating a feedback signal with the sensor, the feedback signal representing at least one measurement by the sensor;

injecting a fluid into the wellbore and into at least a portion of the formation adjacent the sensor;

shutting-in the wellbore for a pre-determined shut-in period;

determining an interval of interest within the wellbore;

measuring characteristics of the interval of interest with the sensor at discrete time periods;

plotting the measurements of the interval of interest against time;

comparing the measurements of the interval with a theoretical measurement curve;

fitting the theoretical curve to the measurements; and determining a volume flow profile for the interval of interest by dividing the wellbore interval of interest into a plurality of sub sections;

repeating measuring, plotting, comparing, and fitting for each of the plurality of sub sections; and determining for each of the sub sections a volume flow profile for the entire wellbore interval of interest.

2. The method according to claim 1 wherein generating comprises generating a feedback signal representing at least one of a temperature and a pressure.

3. The method according to claim 1 wherein determining comprises determining a volume of injected fluid versus a depth of the wellbore.

4. The method according to claim 1 wherein dividing comprises dividing the plurality of sub sections into sub sections of predetermined cross-sectional lengths.

5. The method according to claim 1 wherein the fluid is at least one of a diverting agent and a stimulation fluid.

6. The method according to claim 1 wherein fitting comprises fitting utilizing a numerical optimization algorithm.

7. The method according to claim 1 wherein positioning the sensor comprises positioning the sensor with coiled tubing.

8. The method according to claim 1 wherein positioning the sensor comprises positioning a sensor comprising distributed temperature sensing technology and comprising an optical fiber disposed in the wellbore.

9. A method for determining flow distribution in a formation having a wellbore formed therein, comprising:

positioning a sensor within the wellbore, wherein the sensor provides a substantially continuous temperature monitoring along a pre-determined interval of the wellbore, and wherein the sensor generates a feedback signal representing temperature measured by the sensor;

injecting a fluid into the wellbore and into at least a portion of the formation adjacent the interval;

shutting-in the wellbore for a pre-determined shut-in period;

dividing the pre-determined interval into a plurality of sub sections;

measuring temperature characteristics of each of the subsections at discrete time periods;

plotting the temperature measurements of each of the subsections against time;

comparing the temperature measurements of each of the sub-sections with a theoretical measurement curve;

fitting the theoretical curve to the measurements of each of the sub-sections;

determining the flow distribution for the entire interval of interest; and utilizing the determined flow distribution for a subsequent treatment process.

10. The method according to claim 9 wherein dividing comprises dividing the plurality of sub sections into sub sections of predetermined cross-sectional lengths.

11. The method according to claim 9 wherein the sensor includes distributed temperature sensing technology having an optical fiber disposed along the interval within the wellbore.

12. The method according to claim 9 wherein the fluid is at least one of a diverting agent and a stimulation fluid.

13. The method according to claim 9 wherein fitting comprises fitting utilizing a numerical optimization algorithm.

14. The method according to claim 9 wherein utilizing comprises immediately analyzing the flow distribution in the well, and adjusting, if necessary, a subsequent treatment schedule, to maximize stimulation effectiveness and well production.

15. The method according to claim 9 wherein determining comprises determining a volume of injected fluid versus a depth of the wellbore.

16. A method for determining flow distribution in a formation having a wellbore formed therein, comprising:

positioning a distributed temperature sensor on a fiber extending along an interval within the wellbore, wherein the distributed temperature sensor provides substantially continuous temperature monitoring along the interval, and wherein the sensor generates a feedback signal representing temperature measured by the sensor;

injecting a fluid into the wellbore and into at least a portion of the formation adjacent the interval;

shutting-in the wellbore for a pre-determined shut-in period;

measuring first temperature readings during the shut-in period;

measuring second temperature readings subsequent to the shut-in period;

comparing the first and second temperature measurements with a theoretical measurement curve; and fitting the theoretical curve to the first or second temperature measurements to determine an inversed temperature curve for the injected fluid, an average temperature profile for the wellbore interval prior to receiving the injected fluid and an average volume curve for the injected fluid.

17. The method according to claim 16 wherein positioning the sensor comprises positioning the sensor with coiled tubing.

18. The method according to claim 17 and further comprising utilizing the flow profile to tailor a stimulation operation in the wellbore and thereby maximize the stimulation effectiveness.

19. The method according to claim 18 further comprising performing the stimulation operation, the stimulation comprising at least one of positioning coded tubing to a zone that has not been effectively stimulated to maximize stimulation fluid contact/inflow into that zone, positioning coiled tubing to a zone that has already been fully stimulated to spot a diverting agent to temporarily plug the zone so the subsequent stimulation fluid can flow into other zones that need further stimulation; switching a treating fluid if it is shown ineffective; switching a diverter if it is shown ineffective; and setting a temporary plug or other types of mechanical barrier in the well to isolate the already stimulated zones to allow separate treatment of the remaining zone or zones.

* * * * *